US007610788B2

(12) United States Patent
Anagnostopoulos

(10) Patent No.: US 7,610,788 B2
(45) Date of Patent: Nov. 3, 2009

(54) MACHINE AND METHOD FOR PREVENTING TORSION OF WIRE, MATERIAL OF PRISMATIC CROSS-SECTION, AND ROD MATERIAL

(76) Inventor: Antonios Anagnostopoulos, Bitsi Street 1, Kifissia, Attikis (GR) GR-14562

( * ) Notice: Subject to any disclaimer, the term of this patent is extended or adjusted under 35 U.S.C. 154(b) by 281 days.

(21) Appl. No.: 11/559,488

(22) Filed: Nov. 14, 2006

(65) Prior Publication Data

US 2007/0107483 A1 May 17, 2007

(30) Foreign Application Priority Data

Nov. 15, 2005 (GR) ..... 20050100567

(51) Int. Cl.
*B21D 11/00* (2006.01)

(52) U.S. Cl. ..... 72/307; 72/311

(58) Field of Classification Search ..... 72/15.3, 72/16.2, 17.3, 149, 150, 295, 300, 305, 306, 72/307, 311, 312, 313, 419, 420, 421, 422
See application file for complete search history.

(56) References Cited

U.S. PATENT DOCUMENTS

| | | | | |
|---|---|---|---|---|
| 1,816,484 | A * | 7/1931 | Holmes | 72/422 |
| 2,780,269 | A * | 2/1957 | Hill | 72/154 |
| 4,161,110 | A | 7/1979 | Ritter et al. | |
| 5,136,871 | A | 8/1992 | Lisec | |
| 5,170,654 | A | 12/1992 | Anagnostopoulos | |
| 5,233,853 | A * | 8/1993 | Milliman | 72/20.5 |
| 6,644,079 | B2 * | 11/2003 | Harman et al. | 72/15.4 |
| 6,813,922 | B2 | 11/2004 | Etienne | |
| 7,254,974 | B2 * | 8/2007 | Scott et al. | 72/294 |
| 7,260,969 | B2 * | 8/2007 | Del Fabro et al. | 72/294 |
| 2003/0089153 | A1 | 5/2003 | Etienne | |

FOREIGN PATENT DOCUMENTS

| | | | |
|---|---|---|---|
| EP | 0140859 | A2 | 5/1985 |
| EP | 0371960 | A2 | 6/1990 |
| EP | 0379030 | A1 | 7/1990 |
| EP | 0537496 | A1 | 4/1993 |
| FR | 2553314 | A1 | 4/1985 |
| FR | 2708882 | A1 | 2/1995 |
| GR | 1001322 | B | 7/1993 |

(Continued)

OTHER PUBLICATIONS

International Search Report of Apr. 4, 2006 for GR20050100567, by Greek Patent Office (O.B.I.).

(Continued)

*Primary Examiner*—Edward Tolan
(74) *Attorney, Agent, or Firm*—George Kapsalas; Patentbuero Paul Rosenich AG

(57) ABSTRACT

A machine and method according to which advancing material (1) such as wire, prismatic material, or rod is gripped during the duration of its advancement from an advancement unit (2) towards a bending unit (3). The gripping is effected by a jaw (4) that grips material (1) with sufficient force so that the material (1) cannot twist. By gripping the advancing material (1), the under-production part (16) is simultaneously gripped and prevented from rotating, so that bends are made in the correct plane and the bent product is produced with great accuracy.

19 Claims, 3 Drawing Sheets

FOREIGN PATENT DOCUMENTS

| | | | |
|---|---|---|---|
| GR | 1003131 | B | 5/1999 |
| GR | 1004238 | B | 5/2003 |
| JP | 61-259837 | A | 11/1983 |
| WO | 01/74509 | A1 | 10/2001 |
| WO | WO-03082492 | A1 | 10/2003 |

OTHER PUBLICATIONS

EPO extended search report dated Mar. 18, 2008, 6 pp., European Application No. 06124093.3.

* cited by examiner

MACHINE AND METHOD FOR PREVENTING TORSION OF WIRE, MATERIAL OF PRISMATIC CROSS-SECTION, AND ROD MATERIAL

This application claims foreign priority under 35 U.S.C. 119 to prior Greek (GR) national application no. 20050100567 filed on Nov. 15, 2005, the entire contents of which are hereby incorporated herein by reference.

BACKGROUND OF THE INVENTION

1. Field of the Invention

The present invention relates to machines and method, according to which advancing wire, material of prismatic cross-section, or rod material may be gripped in a suitable manner, so that they are not displaced from the geometrical plane of bending at bending machines, or so that they do not undergo torsion while being advanced.

2. Description of Related Art

In a bending machine, the wire, material of prismatic cross-section, or rod material is advanced towards the bending head, where it is bent to a desired angle. The desired shape is produced by sequential advancements and bendings at the desired sizes to produce a product.

In bending machines producing planar shapes it is required that the under-production product be located within the plane of bending. In bending machines producing three-dimensional products, it is required that the bends be effected within specific planes so that there is no distortion of the under-production product displaced outside of the bending planes.

The advanced material—wire, material of prismatic cross-section, or rod material—present tolerances as to their dimensions and as to their mechanical characteristics. Particularly rods may have the characteristics of irregular external surface, of distributed ribs along the rod axis, of longitudinal ribs, of the twisting of longitudinal ribs along the length of the rod, and of the deviation of the cross-section from a perfect circular shape.

When the wire, the material of prismatic cross-section, or the rod material is advanced by rollers, it may twist in relation to the axial line as a result of the deviations of its external dimensions from the perfect circle. Consequently the under-production part twists and is displaced out of the bending plane. In this manner, a two-dimensional product is deformed out of and displaced out of its plane; and a three-dimensional one is distorted as the bending planes are displaced.

Furthermore, during the production of three-dimensional products, as the product is produced in the production space there is displacement of the center of mass in the production space and this same product mass of the product causes torsion of the wire, the prismatic material, or the rod material, so that finally there is undesirable distortion of the under-production product.

In straightening machines with rotors, rollers, or dies the material being straightened may rotate during straightening. Thus, even though the rotor effects straightening of high quality, it cannot be used as a straightening unit in bending machines because of the rotation of the under-production part, and the product is bent outside the geometric plane of bending.

SUMMARY OF THE INVENTION

It is an object of the present invention to provide machines and methods which will overcome these and other disadvantages of prior systems.

It is a further object of the invention to provide machines and methods that may find easy application within existing bending machines.

Thus, one object of the present invention is to present a machine and method that prevents the generation of torsion of the wire, material of prismatic cross-section, or rod material, in bending machines in the space between the advancer and the bending head, or so that advancing wire does not undergo torsion while being advanced.

It is an object of the present invention to present a machine that can restrain the wire, the prismatic material, or the rod material during the duration of advancement, and that can prevent torsion and the rotation of an under-production part.

Thus, in one aspect the invention has as an objective to provide an antitorsion machine and an antitorsion method for a bending machine comprising, an antitorsion jaw assembly configured to grip wire against torsion;

a carrier configured to carry said antitorsion jaw assembly;

a guide configured to movably support said carrier;

a return mechanism configured to pull said carrier in a first direction along said guide; and, a motor configured to activate said antitorsion jaw assembly to grip advancing wire for passively advancing said antitorsion jaw assembly and said carrier in a second direction along said guide.

In another aspect, the invention has as an objective to provide a method and a bending machine preventing torsion in wire, comprising, a bending unit configured to bend wire;

an advancement unit configured to advance wire to said bending unit;

an antitorsion jaw assembly disposed between said advancement unit and said bending unit;

a carrier configured to carry said antitorsion jaw assembly;

said carrier being movably supported on a guide;

a return mechanism configured to return said towards said advancement unit; and, said antitorsion jaw assembly is configured to grip advancing wire to pull along said jaw assembly, said carrier, and said return mechanism.

As a further objective the invention, there are presented a method and machine having particular advantages in that:

The system and method are of relatively small cost.

Placement within a bending machine is facilitated.

The operation of the machine and method may be readily automated.

More details about the method and the machine according to the present invention will be better comprehended during the immediately following detailed description of exemplary particular implementations of versions of the invention. The machine and method are described in the attached figures, in the sense of non-restrictive examples and without limitation in the range of the applications of the machine and method. These and other features, aspects, and advantages of the present invention will become better understood with regard to the following description, appended claims, and accompanying drawings, where:

DETAILED DESCRIPTION

Definitions: For simplicity and ease of reference thereto, the terms "wire," "wire rods," "rods," "tubes," "rod material," "material of prismatic cross-section," and "prismatic material are used interchangeably and equivalently throughout the remainder of the detailed description and appended claims. Thus artisans in the art will readily understand that the term "wire" within the appended claims encompasses and includes the aforesaid "rods," "rod material," "prismatic material," and generally "material of prismatic cross-section" without differentiation unless such differentiation is explicitly set forth. Thus, all these known, utilizable materials of prismatic cross-section may be conveniently and clearly referred to in non-limiting brief form by the terms "wire," or "rod" within the text of the description which immediately follows and within the appended claims.

Figure 1:
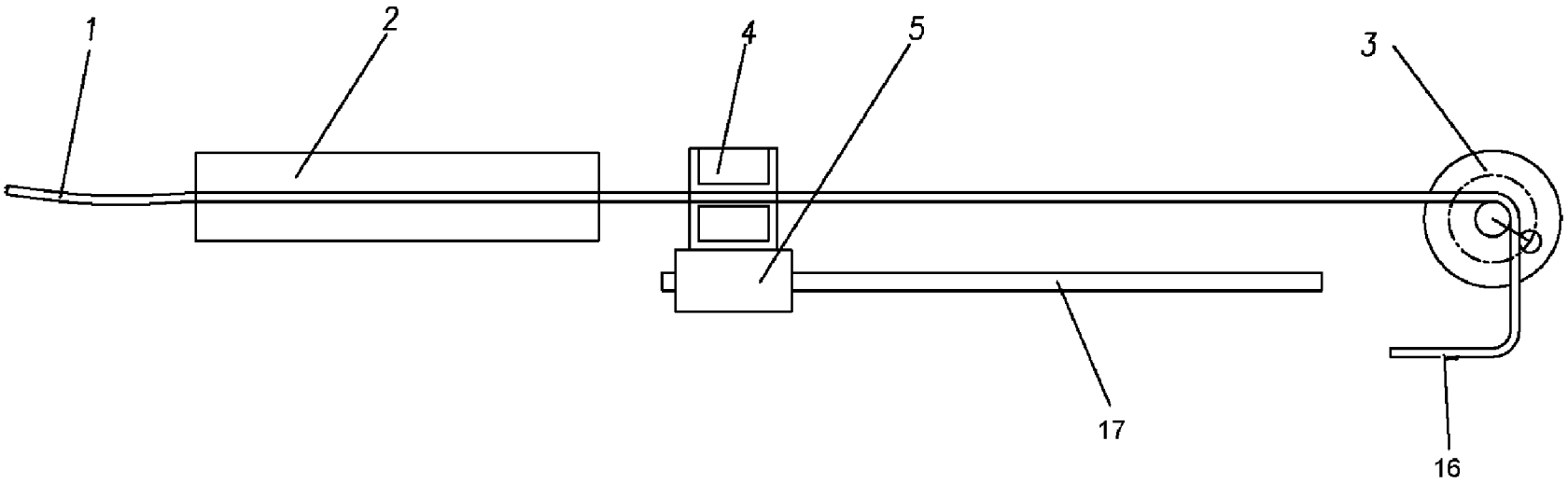
FIG. 1. An illustration of the method of preventing torsion.

Turning to FIG.1, in accordance with the method of the present invention the wire (1) is gripped during the duration of its advancement from the advancement unit (2) towards the bending head (3) with a jaw (4) that grips it with sufficient strength so that it cannot twist about its axis. Gripping of the advancing material simultaneously grips also the under-production part (16) so that the bends are made in the correct plane and so that the product is produced with great accuracy. As depicted, the antitorsion jaw assembly (4) is mounted on a carrier (5) so that it moves parallel with the advancing material (1).

The step of gripping results from the exercise of mechanical forces on the wire (1). In this manner the advancing material (1) is gripped by the jaw (4), which jaw (4) remains fixed relative to carrier (5) so that the advancing material (1) cannot twist or rotate. Simultaneously, the same advancing material (1) advances the jaw (4) along with the carrier (5), upon guide (17) by pulling or carrying them along. Gripping of the advancing material (1) occurs during the duration of displacement of the jaw (4) from the advancement unit (2) towards the bender (3).

The cycle of gripping is as follows: With the beginning of advancement of material (1), the antirotation jaw assembly (4) is energized, the advancing material (1) is gripped steadily with sufficient force so as to not permit twisting of the advancing material (1) and rotation of the under-production part (16). The jaw (4) is synchronized to and is carried along by the advancing material (1) until it approaches the bending unit (3). There, selectively stops the advancement of material (1) and the jaw (4) is deenergized and returns to its initial position. If advancement stops so that bending may be made, then return of the jaw (4) to its starting position may occur during the duration of bending of the material (1).

The step of return of the jaw (4) towards the advancement unit (2) may be effected by the action of some applied force, or via the motion of some cylinder or motor, and this shall be further explained below in the description of the antirotation machine.

As explained above the jaw (4) may be displaced pulled or carried along by the advancing material (1), but however may move forced by an applied force and be synchronized with the motion of the material (1) advanced by an advancing unit (2).

The unit (2) may be an advancement unit for straightened wire, or it may follow a straightening unit that straightens unstraightened materials, or it may be a simultaneous straightening-advancement unit. The straightening unit may be of any type, such as two-level with rollers, rotor with rollers, or rotor with dies.

Figure 2:
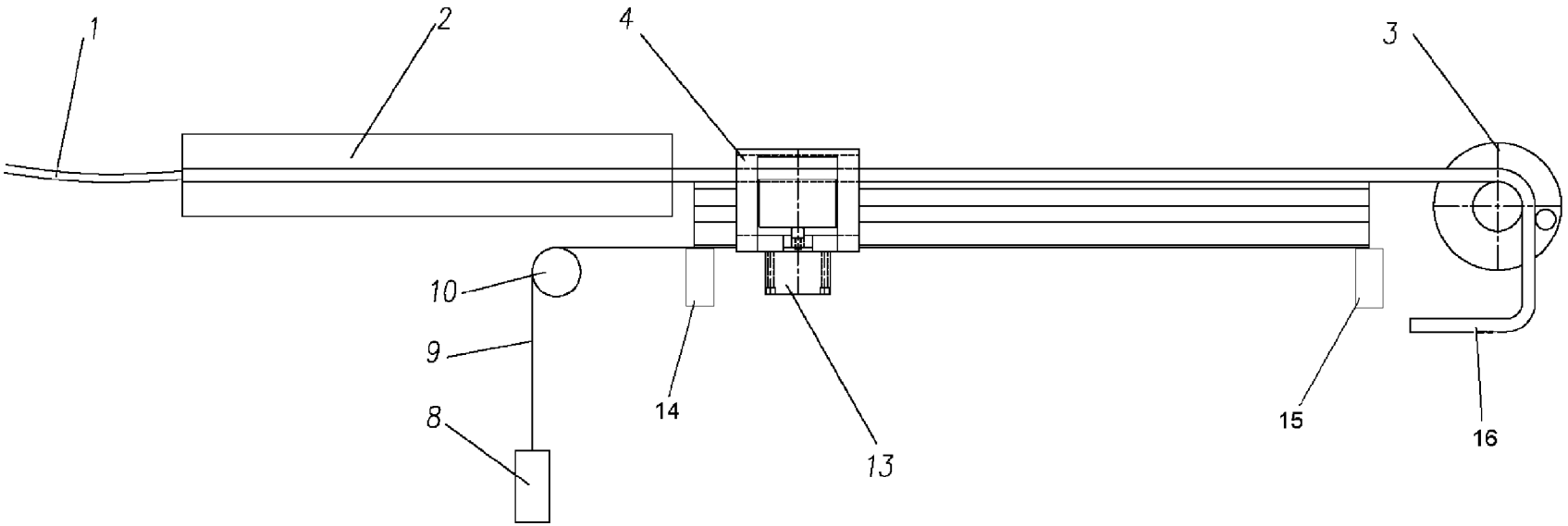
FIG. 2. The antitorsion machine in plan view.
Figure 3:
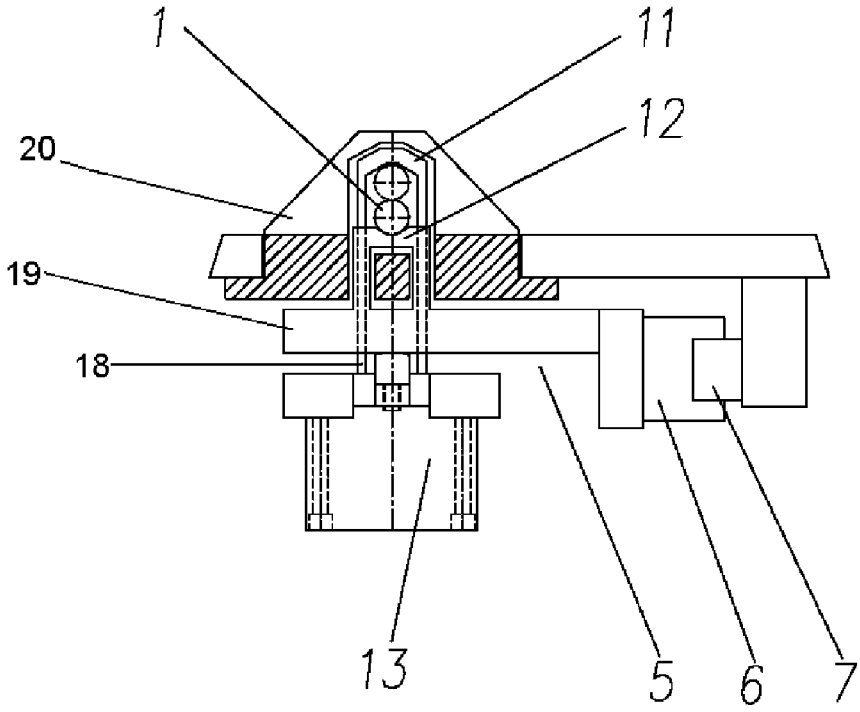
FIG. 3. The antitorsion machine with antitorsion jaw in partial sectional view.

Turning to FIG. 2 and FIG. 3, versions of the machine and method for preventing torsion of wire may be further understood by way of further examples. As previously explained, the wire (1) is gripped during the duration of its advancement by an antirotation jaw (4) which moves within the space between advancer (2) and bender (3). As further depicted in FIG. 2, the return of the jaw (4) in the direction towards the advancement unit (2) is made by a return mechanism (8). This return mechanism (8) may utilize the action of gravity, the action of a spring, or the action of a motor or an electromechanical drive. Advantageously, the return mechanism (8) may comprise the weight of a mass (8) acting on the carrier (5) via a wire rope (9) passing over a pulley assembly (10) as depicted. In this last example, the weight of mass (8) permanently biases the carrier (5) towards the side having the advancer (2).

Thus, from the a foregoing description may be understood a method of preventing torsion in wire, prismatic material and rods (1), in which a jaw (4) mechanically grips the material advanced by rollers (2), so that it cannot twist or rotate in the interval between advancer (2) and bender (3), with result that the under-production part (16) does not rotate.

In following to the immediately preceding paragraph above the jaw (4) may grip the advancing material (1) during the duration of its advancement and may simultaneously be carried along by the advancing material (1). Also in following to the immediately preceding paragraph above the jaw (4) may grip the advancing material (1) during the duration of its advancement and the jaw's motion may be forcibly synchronized with advancing material (1) by assistance of an appropriate machine.

In following to either of the immediately preceding two paragraphs above the jaw (4) may return to its starting position when the travel path of its carrier (5) is completed, or when the bending of the material (1) begins or during the duration of bending of the material (1).

Having considered the return of the antirotation jaw assembly (4), it may be further understood as depicted in FIG. 2, that the limits of motion of the jaw (4) may be defined by limit switches (14,15), for example respectively at the beginning (14) and end (15) of the travel path.

Turning to FIG. 3, the antirotation jaw assembly (4) may comprise two jaw pieces (11,12), the first piece (11) being movable and having a portion (18) extending through the carrier (5), the fixed second jaw piece (12) extending from above the carrier. A cover (20) may overlie the jaw pieces (11,12). In further example, the carrier (5) as depicted may include a carrier plate (19) that is mounted on linear wagon carriers (6) which themselves are guided on a linear rail guide (7). Thus, the motion of the carrier (5) may be implemented by a linear carrier and linear bearings such as linear ball bearings and rollers.

In further aspect, the movable, first jaw piece (11) is connected to a motor (13) mounted on the carrier (5), for example below said carrier plate (19) as depicted in FIG. 3. The gripping force exercised by antirotation jaw assembly (4) may be from compressed air, hydraulic, or electromechanical. Thus, the motor (13) may be, for example, a pneumatic cylinder type, a hydraulic motor, or an electromechanical drive.

The operation of the antitorsion machine may be additionally explained as follows. With the start of wire advancement, antirotation jaw assembly (4) is activated by energization of motor (13) and thus movable jaw piece (11) is actuated to firmly grip one or two wires (1) as shown in FIG. 3 on fixed jaw piece (12), thereby preventing torsion. In this manner, the advancing material (1) does not twist, and the under-production part (16) does not rotate, and the jaw (4) and carrier (5) are pulled along and passively advanced along the guide (7, 17).

The gripping continues until either the travel path of the carrier (5) of the jaw (4) is completed, or until completion of the advancement so that the bending may be made in the already-advanced material. At the time that advancement stops, the motor (13) holding the wire (1) may be deenergized, and the carrier (5) with the antirotation jaw assembly (4) thus freed to effect the return to a starting position as discussed in the aforegoing description. Then, with the restarting of advancement, the cycle may repeat from start.

Thus according to the aforegoing description there is disclosed a system for preventing torsion in wire, prismatic material and rods (1), characterized in that a mechanical jaw (4) mounted on a carrier (5) can grip the material (1) advanced by rollers (2) and does not permit it to rotate during the duration of advancement in the interval between advancer (2) and bender (3), with the return of the machine being made with gravitational force exercised by a suspended mass (8).

In following to the immediately preceding paragraph above, the mechanical jaw (4) may be mounted on a linear carrier (5). Also in following to the immediately preceding paragraph above the gripping force at the jaw (4) may be exercised by compressed air with a pneumatic cylinder (3). Further in following to the immediately preceding paragraph above the mechanical jaw (4) may return to the starting position with the action of a weight (8) which transfers its load to the carrier (9). Yet further in following to the immediately preceding paragraph above the mechanical jaw (4) may grip the wire and the product during the duration of advancement until the end of travel of the carrier (5), or until bending of the material begins, or during the duration of bending of the material (1).

Various exemplary devices and methods have been illustrated in the accompanying drawings and described in the foregoing detailed description but it will be understood that the claims to the methods and devices shown and described are not limited to the particular embodiments described herein, as these may be capable of numerous rearrangements, modifications, and substitutions without departing from the scope and spirit of the claims set forth below. Consistent with legal precedent, the spirit and scope of the appended claims should not be limited to the description of the preferred versions contained herein. Accordingly, the techniques and structures described and illustrated herein should be understood to be illustrative only and not limiting upon the scope of the present invention. The scope of the present invention is defined by the appended claims, including known equivalents and unforeseeable equivalents at the time of filing of this application.

What is claimed is:

1. A bending machine preventing torsion in wire, comprising:

a bending unit configured to bend wire;

an advancement unit configured to advance wire to said bending unit;

an antitorsion jaw assembly disposed between said advancement unit and said bending unit;

a carrier configured to carry said antitorsion jaw assembly;

said carrier being movably supported on a guide;

a return mechanism configured to bias said carrier in the direction towards said advancement unit;

said antitorsion jaw assembly is configured to grip advancing wire to pull along said jaw assembly, said carrier, and said return mechanism; and, a motor configured to actuate said antitorsion jaw assembly to grip wire.

2. The bending machine preventing torsion in wire as claimed in claim 1, wherein:

said return mechanism includes a weight.

3. The bending machine preventing torsion in wire as claimed in claim 1, wherein:

said return mechanism includes a spring.

4. A bending machine preventing torsion in wire as claimed in claim 1, further comprising:

said carrier including a plate; and, said carrier further including a wagon carrier connected to said plate and movably supported on said guide.

5. The bending machine preventing torsion in wire as claimed in claim 4, wherein:

said antitorsion jaw assembly is mounted on said plate.

6. A bending machine preventing torsion in wire as claimed in claim 5, further comprising:

said antitorsion jaw assembly including a first jaw piece extending through said plate.

7. A bending machine preventing torsion in wire as claimed in claim 1, further comprising:

a limit switch configured to detect position of said antitorsion jaw assembly between said advancement unit and said bending unit.

8. The bending machine preventing torsion in wire as claimed in claim 1, wherein:

said motor comprises a pneumatic motor.

9. A bending machine preventing torsion in wire, comprising:

a bending unit configured to bend wire;

an advancement unit configured to advance wire to said bending unit;

an antitorsion jaw assembly disposed between said advancement unit and said bending unit;

a carrier configured to carry said antitorsion jaw assembly;

a first jaw piece, said first jaw piece having a portion extending through said carrier; and, a second jaw piece extending from above said carrier; and, a motor connected to said portion and configured to actuate said first jaw piece to grip wire between said first jaw piece and said second jaw piece to result in said antitorsion jaw assembly and said carrier being pulled along by advancing wire.

10. A bending machine preventing torsion in wire as claimed in claim 9, further comprising:

a limit switch configured to detect position of said antitorsion jaw assembly between said advancement unit and said bending unit.

11. A bending machine preventing torsion in wire as claimed in claim 9, further comprising:

a return mechanism configured to return said carrier in a direction toward said advancement unit.

12. The bending machine preventing torsion in wire as claimed in claim 9, wherein:

said motor is a pneumatic motor.

13. An antitorsion assembly for a bending machine, comprising:

an antitorsion jaw assembly configured to grip wire against torsion;

a carrier configured to carry said antitorsion jaw assembly;

a guide configured to movably support said carrier;

a return mechanism configured to pull said carrier in a first direction along said guide; and, a motor configured to activate said antitorsion jaw assembly to grip advancing wire to pull along said jaw assembly for passively advancing said antitorsion jaw assembly and said carrier in a second direction along said guide.

14. The antitorsion assembly for a bending machine and claimed in claim 13, wherein:

said return mechanism includes a weight.

15. An antitorsion assembly for a bending machine and claimed in claim 13, further comprising:

a limit switch configured to detect position of said antitorsion jaw assembly along said guide.

16. An antitorsion assembly for a bending machine and claimed in claim 13, further comprising:

said carrier including a plate; and, said carrier further including a wagon carrier connected to said plate and movably supported on said guide.

17. An antitorsion assembly for a bending machine and claimed in claim 16, further comprising:

said antitorsion jaw assembly including a first jaw piece extending through said plate.

18. An antitorsion assembly for a bending machine and claimed in claim 17, further comprising:

said antitorsion jaw assembly including a second jaw piece extending from said plate.

19. The antitorsion assembly for a bending machine and claimed in claim 18, wherein:

said motor activates said first jaw piece.

* * * * *